United States Patent [19]

Newmark

[11] Patent Number: 5,058,788

[45] Date of Patent: Oct. 22, 1991

[54] LEG HOLSTER ASSEMBLY

[76] Inventor: Don B. Newmark, 1740 W. Cameron Ave., Suite 106, West Covina, Calif. 91790

[21] Appl. No.: 321,974

[22] Filed: Mar. 9, 1989

[51] Int. Cl.[5] ..... F41C 33/02

[52] U.S. Cl. ..... 224/222; 224/198; 224/238; 224/243; 224/901; 224/911; 224/912; 224/264; 224/907

[58] Field of Search ..... 224/198, 222, 238, 243, 224/244, 911, 912, 901, 264, 907

[56] References Cited

U.S. PATENT DOCUMENTS

| | | | |
|---|---|---|---|
| 2,641,395 | 6/1953 | Engle | 224/198 |
| 3,261,519 | 7/1960 | Horne | 224/198 |
| 4,029,242 | 6/1977 | Stoesser | 224/222 |
| 4,258,871 | 3/1981 | McMahon | 224/911 X |
| 4,410,118 | 10/1983 | Taurisano | 224/222 |
| 4,696,419 | 9/1987 | Holtzclaw, Jr. et al. | 224/243 |
| 4,706,307 | 11/1987 | Padfield et al. | 128/882 X |
| 4,710,991 | 12/1987 | Wilmore et al. | 128/76 R |

*Primary Examiner*—Ernest G. Cusick

*Attorney, Agent, or Firm*—Thomas A. Turner, Jr.; Seymour A. Scholnick

[57] ABSTRACT

A first wrap adapted to wrap around the lower leg generally over the medial malleolus and above the lateral malleolus is connected by a strap to a second wrap adapted to wrap around the lower leg generally on the upper portion of the gastrocnemius or below the popliteal fossa. The first wrap has a holster for carrying a firearm and which holster is secured approximately over the medial malleolus. The holster may be selectively detachable to allow a selection of holsters to be secured to the first wrap. The second wrap carries the substantial portion of the weight of load of the assembly, and of any holster and firearm secured thereto.

15 Claims, 2 Drawing Sheets

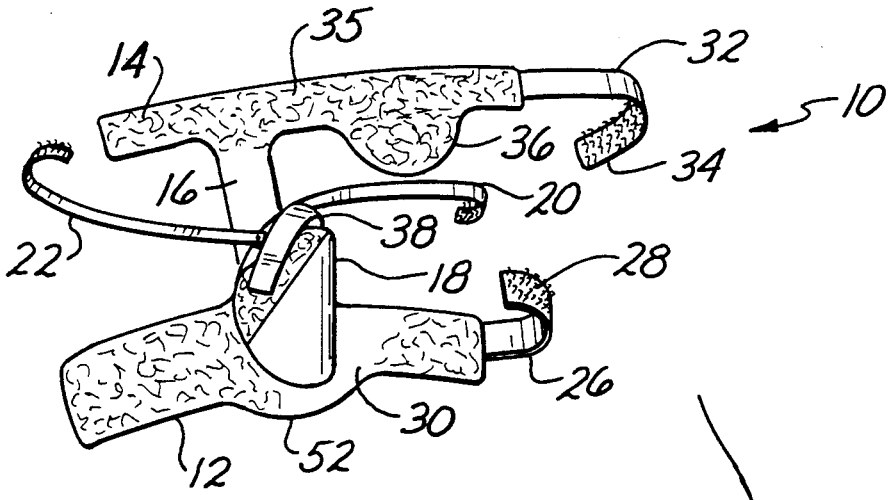
Fig. 1
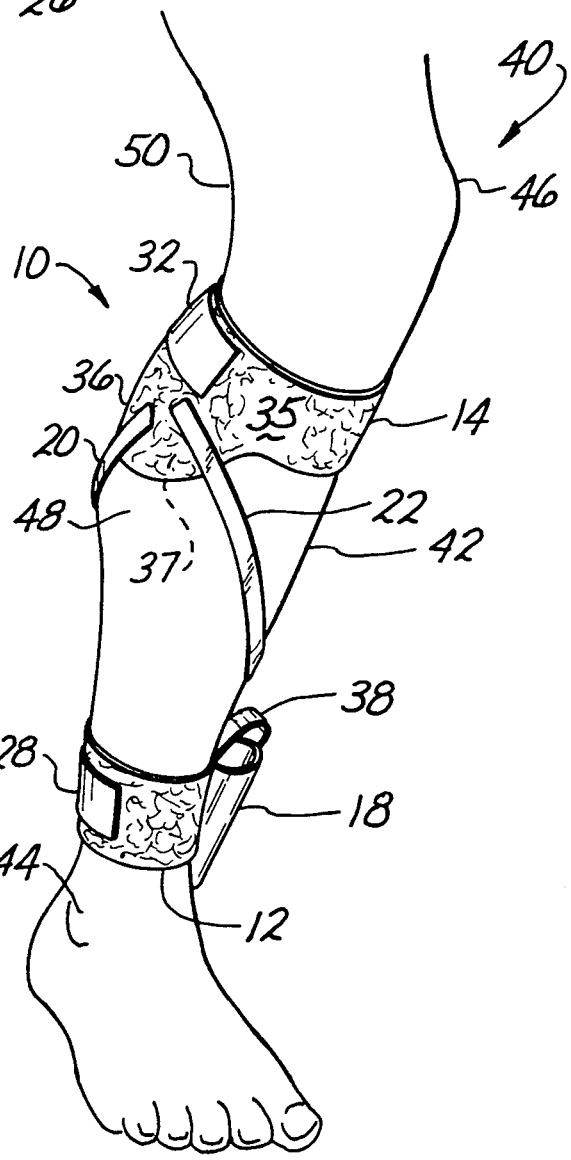
Fig. 2
Fig. 3
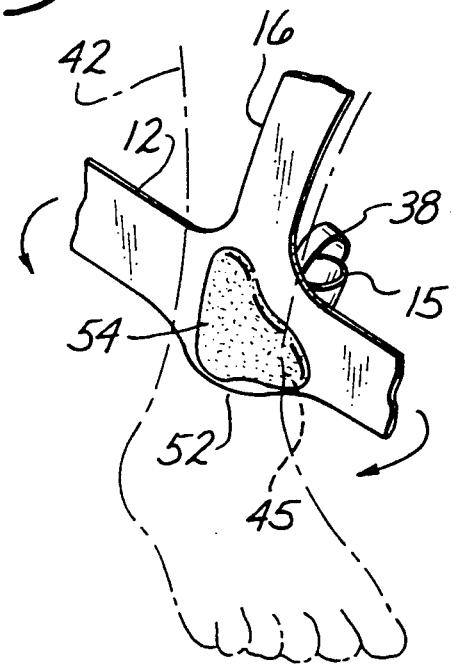

LEG HOLSTER ASSEMBLY

BACKGROUND OF THE INVENTION

1. Field of the Invention

The present invention relates to the art of firearm holsters, and more particularly to holsters for holding firearms along extremities of the body.

2. Description of the Prior Art

In the past, holsters have been provided to secure firearms in vehicles, saddles, airships, desks and other and various locations as well as the body of a person. Holsters adapted to secure firearms to the body of a person include leg or ankle holsters which are usually designed to wrap around the ankles of the lower leg of the person. Such firearms so secured are somewhat out of sight, are usually accessible with little effort and with speed and dispatch.

Ankle holsters presently available, however, must be secured very tightly, for the lower leg is subjected to fast, articulated movements that will tend to sling the holster off the body. Unless the holster is tight against the lower leg, rubbing may occur that will cause substantial discomfort, skin lesion and other problems. Moreover, it is important for fast drawing of the firearm secured in the holster that the holster remain at one position around the leg so that when a hand reaches down to withdraw the firearm, the firearm is in the location or position around the leg where it is most expected.

Firearms, and guns in general are relatively heavy items, and will have a tendency to sling around during the articulated movement of the lower leg, especially when the wearer is engaging in fast movement such as chasing suspected criminals and breaking down doors of premises where suspected criminal activity takes place. To accomplish the desired objectives when wearing an ankle holster and gun, it is customary for wearers to secure the belt or wrap of the ankle holster very tightly around the ankle area of the lower leg, often times so tightly that vascular circulation is constricted or restricted. Further, it has been known that firearms held in such holsters have dug into the skin and flesh in the lower leg so as to pinch nerves, restrict movement of the foot relative to the ankle and leg, and to otherwise cause very serious medical problems such as gangrene. In effect, such holsters and holster assemblies have been used so that a tourniquet results.

It has long been desired to provide a holster and holster assembly which securely and tightly holds a gun or like firearm stationary relative to the lower leg, and proximate a malleolus of the lower leg, but which need not be so tightly secured to the malleoli region that vascular circulation is restricted. It has long been desired to provide a lower leg holster and holster assembly which can be worn for extended periods of time without encountering the danger of gangrene from loss of vascular circulation, crushed nerves and other problems that a tourniquet causes.

SUMMARY OF THE INVENTION

In brief, in accordance with one aspect of the present invention, a holster assembly is provided having a first wrap designed to wrap around the ankle region of the lower leg of a person. The first wrap wraps around the lower leg generally over the medial malleolus and generally above the lateral malleolus. The first wrap is connected by a strap column to a second wrap, which is designed to be wrapped around the lower leg generally on the upper portion of the gastrocnemius or perhaps generally below the popliteal fossa. The second wrap has a flange which extends downwardly to cover and contact the head of the fibula.

Cinch straps connect at one of their ends to the first wrap generally above the connection of the first wrap to the holster, and connect at their other ends to the flange on the second wrap so that they generally extend around the calf of the leg, to further carry weight from the first wrap to the second wrap in a contra-levered weight transfer or distribution. The cinch straps and the strap column transfer substantially all of the weight of the first wrap to the second wrap, so that the gastrocnemius or the popliteal fossa of the leg assumes the weight load of substantially all of the holster, firearm and holster assembly.

The holster may be detachably secured to the first wrap so that it may be removed at will, and differently shaped holsters substituted on the first wrap.

Other novel features which are believed to be characteristic of the invention, both as to organization and methods of operation, together with further objects and advantages thereof, will be better understood from the following description in which preferred embodiments of the invention are described by way of example.

BRIEF DESCRIPTION OF THE DRAWINGS

FIG. 1 is a perspective view of the preferred embodiment of the present invention showing the holster assembly including a holster;

FIG. 2 is a perspective view of a lower leg showing the preferred embodiment of the present invention shown in FIG. 1 in relation to the lower leg;

FIG. 3 is a partial view of a detail of the preferred embodiment of FIG. 1, showing part of the lower leg in phantom for clarity in observation;

DESCRIPTION OF THE PREFERRED EMBODIMENTS

Figure 4:
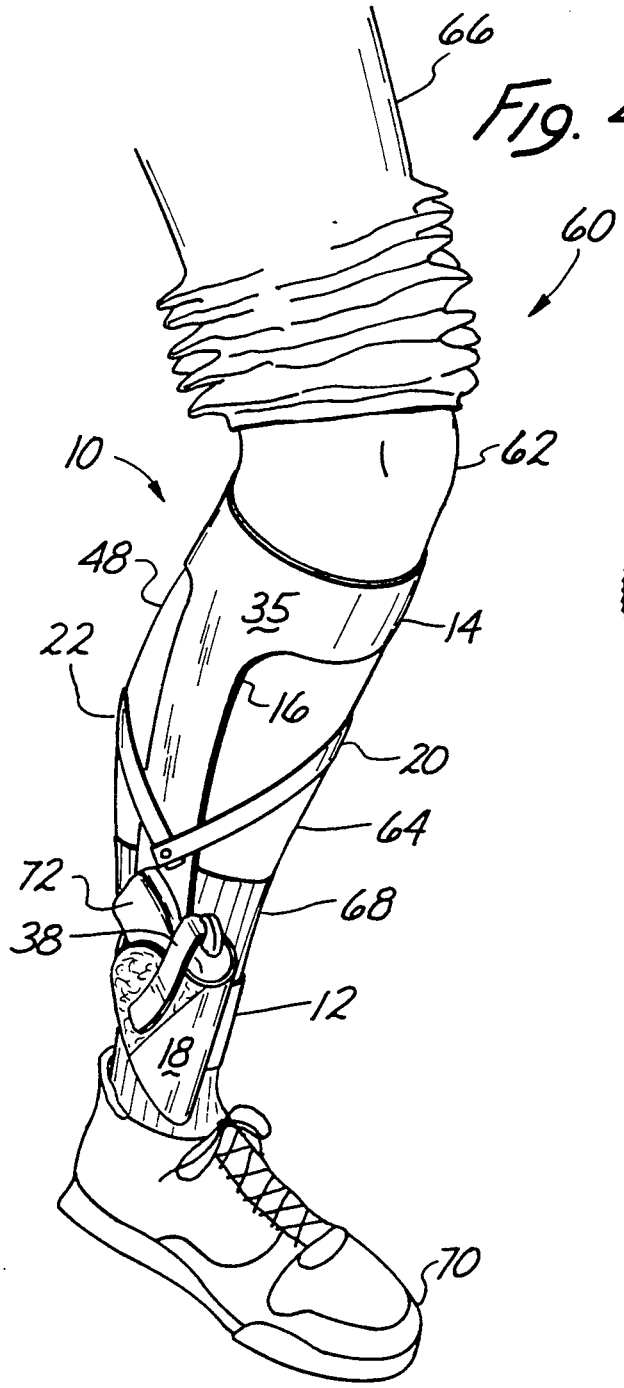
FIG. 4 is a perspective view of the lower leg showing the preferred embodiment of the present invention of FIG. 1 in application and use, and showing a firearm secured in a holster thereon.

A holster assembly 10, reference being had initially to FIG. 1 of the accompanying drawings, comprises a lower wrap 12 and an upper wrap 14. A connector strap or column 16 connects the lower wrap 12 and upper wrap 14. A holster 18 is secured to the lower wrap 12. Cinch straps 20, 22 are connected to the lower wrap 12 slightly above the holster 18.

The lower wrap 12 has a fastening extension 26 which comprises one surface having the male portion of a Velcro fastening system fabricated thereon. The outside surface 30 of the lower wrap 12 is fabricated having the female portion of a Velcro fastening system, so that when the surface 28 of the extension 26 is pressed against the surface 30, the lower wrap 12 can form a circle around an object, as will be explained in greater detail below.

The upper wrap 14 also is made having an extension 32 which has one of its surfaces 34 fabricated with the male portion of a Velcro fastening system. The outside surface 35 of the upper wrap 14 likewise has the complemental female portion of the Velcro fastening system fabricated thereon. In operation, as will be explained in greater detail below, the surface 34 can be pressed against the surface 35 of the upper wrap 14 to make a fastened loop or circle around some object. The upper wrap 14 has an extension or flange 36 extending downwardly from the wrap 14, and has its outside surface fabricated having the female portion of the Velcro fastening system.

The holster 18 has a gun securing strap 38 fixed to the holster at one of its ends, and has male portion of the Velcro fastening system on the surface of its other end. The holster 18 itself has the complemental female portion of the Velcro fastening system fabricated on its outside surface 18 for receiving the end of the strap 38 having the Velcro fastening fabrication thereon.

In FIG. 2, the holster and holster assembly 10 is shown attached to the right leg 40 of a person. As shown, the right leg 40 comprises a lower leg 42 having a lateral malleolus 44 slightly above the foot. The calf or gastrocnemius 48 is shown slightly below the popliteal fossa 50 of the leg 40. The holster assembly 10 of FIG. 1 is fastened to the lower leg 42 by the upper wrap 14 and the lower wrap 12. The lower wrap 12 is wrapped around the lower leg 42 by pressing the extension 26 against the Velcro fastening material on the surface 30 so that the lower wrap 12 surrounds the lower leg 42 slightly above the lateral malleolus 44 and covers the medial malleolus 45, shown in phantom in the view of FIG. 3, on the opposite side of the ankle from the lateral malleolus 44.

The lower wrap 12 has a flange 52 extending downwardly where the holster 18 is fixed to the lower wrap 12 so that the holster 18 generally will not contact the skin of the lower leg 42. The flange 52 and the lower wrap 12 in general, covers the medial malleolus 45. The inner or skin facing surface of the lower wrap 12 has a pad of gel 54 positioned along the inner surface to cushion the contact between the lower wrap 12 and the skin of the lower leg 42. The flange 52 generally covers the lateral malleolus 45, so that the gel pad 54 will contact the lateral malleolus 45. The gel 54 may be any suitable gel that is firm but fluid enough to form around the lateral malleolus and skin of the lower leg 42 into which the gel 54 comes into contact, one such gel being Poron gel made by Boyd Corporation of Orange County, Calif.

The upper wrap 14 is wrapped around the lower leg 42 generally around the region below the popliteal fossa so that the upper wrap 14 rest on the upper portion of the calf or gastrocnemius 48. The Velcro fabricated side 34 of the strap extension 32 is pressed against the Velcro fabricated surface 35 of the upper wrap 14 securing the upper wrap 14 around the lower leg 42. The flange 36 covers the head of the fibula 37 to protect it and to prevent nerve damage to the fibula nerves. As will be seen in FIG. 2, the flange 36 is positioned on the opposite side of the lower leg 42 from the holster 18 and from the point where the cinch straps 20, 22 are fixed to the lower wrap 12.

The cinch strap 20 is wrapped around the lower leg and fastened at its free end to the flange 36 of the upper wrap 14 by pressing Velcro male portions fabricated on a surface of the cinch strap 20 against the Velcro fabricated surface 35 of the flange 36. Similarly, cinch strap 22 is wrapped around the lower leg and fastened at its free end to the flange 36 of the upper wrap 14 by pressing Velcro male portions fabricated on a surface of the cinch strap 22 against the Velcro fabricated surface 35 of the flange 36. Thus, the cinch straps 20, 22 in effect distribute the weight of the holster and any gun or firearm held therein partially to the opposite side of the lower leg 42 from the holster 18 and gun themselves, and to the opposite side of the lower leg 42 from the connector column 16, to result in a "contra-levered" or perhaps a "cross-levered" weight suspension of the holster 18 from the upper wrap 14.

In FIG. 4, another view of the application and use of the present invention is seen, where here a left leg 60 is shown having a knee 62 and lower leg 64. Pants 66 are shown rolled up to show the holster assembly 10 as applied to the lower leg 64. A sock 68 and a shoe 70 are shown in their normal locations on the leg 60. The holster assembly 10 is assembled on the leg 60, having the upper wrap 14 wrapped around the lower leg 64 so that the wrap 14 rests on the upper portion of the gastrocnemius 48, suspending the weight of the lower wrap 12 by the suspension column 16 and by the cinch straps 20, 22. The holster 18 is attached to the lower wrap 12, and secures gun 72 in it by strap 38. Again, as shown in FIG. 2, the cinch straps 20, 22 are attached to the lower wrap 12 on the inside of the leg 60, and to the upper wrap 14 on the opposite or outside of the leg 60 to result in the "cross-levered" weight suspension of the lower wrap 12, holster 18 and gun 72.

Figure 5:
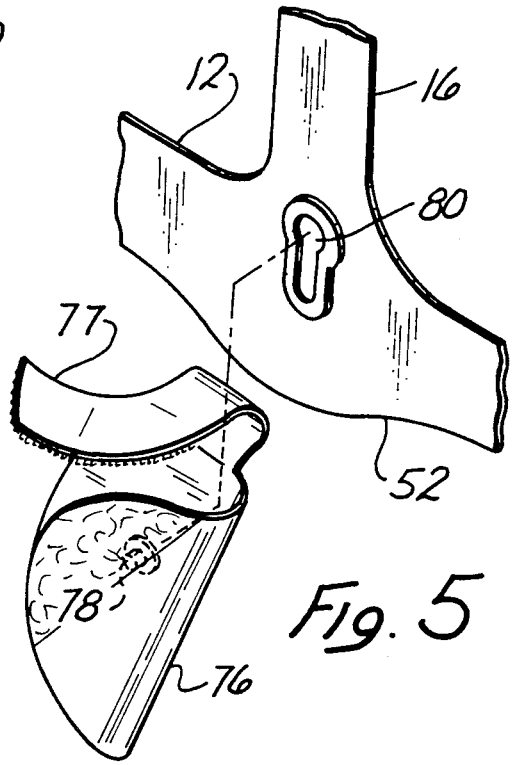
FIG. 5 is a partially exploded, perspective view of an alternative embodiment of the present invention showing a holster detached from a part of the holster assembly.
Figure 6:
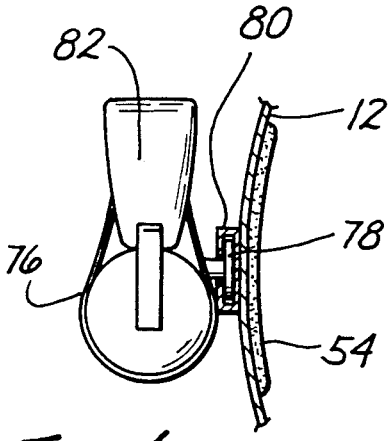
FIG. 6 is a partial cross-section, top view of the alternative embodiment of the present invention shown in FIG. 5, showing a firearm mounted within a holster.

In FIGS. 5 and 6 an alternative embodiment of the present invention is shown for the holster and assembly relationship. In particular, the holster assembly is as described in the embodiment of FIGS. 1 through 4, having a lower wrap 12 and suspension column 16. The lower wrap 12 has a flange 52 extending downwardly to cover the medial malleolus as described above.

The holster 76, in the embodiment of FIGS. 5 and 6, is detachable from the holster assembly. The holster 76 has a securing strap 77 to hold a gun 82 or like firearm in the holster 76. The holster 76 has a fixing stud 78 for attaching the holster 76 to the lower wrap 12 through the slot 80. The slot 80 has a raceway in which the flanged head of the stud 78 slides to securely fasten the holster to the lower wrap 12.

In operation, the holster assembly 10 of the preferred embodiment of the present invention is secured to the lower leg 42, 64 of a person, having the upper wrap 14 wrapped around the upper portion of the gastrocnemius 48 and secured tightly by adjusting the strap 32 and pressing the surface 34 to the complemental Velcro surface 35 of the wrap 14. The lower wrap 12 is wrapped around the ankle area of the lower leg 42, 64 and secured by adjusting the strap 28 and pressing the Velcro surface 28 to the complemental Velcro surface 30 of the lower wrap 12. The lower wrap 12, however, is not wrapped so tight that vascular circulation or nerve crushing results. Rather, the lower wrap 12 is adjusted only for the purpose of holding the holster 18 close to the leg 42, 64 and not for the purpose of holding the holster 18 and its contents against gravity. The weight of the holster 18 and any gun 72 held therein is suspended through cinch straps 20, 22 and the suspension column 16 to the upper wrap 14, which transfers the weight to the upper portion of the gastrocnemius 48. Rotational movement of the holster 18 around the lower leg 42, 64 is limited by the suspension column 16, and is limited further by the cross pattern of the cinch straps 20, 22 The gel pad 54 rests against the lateral malleolus 45 on the flange 52 to protect the lateral malleolus 45.

The crossed pattern of the cinch straps 20, 22 along with the suspension column 16 effectively distributes the weight load held by the upper wrap 14 more evenly around the circumference of the lower leg 42, 64 at the upper end of the gastrocnemius 48, a portion of the leg 40, 60 which can more efficiently and safely hold the weight of the holster 18, holster assembly 10 and gun 72. The flange 36 of the upper wrap 14 covers and rests against the head of the fibula. With the more even distribution of the weight around the gastrocnemius 48, the weight resting against the head of the fibula is substantially reduced and important nerves of that region are less susceptible to being crushed. Further, crushing of the nerves in and around the malleoli 44, 45 is very substantially reduced if not eliminated, yet the holster 18 is held firmly against the lower leg 42, 64 without damage to the nerves, skin or bone structure.

In operation, the alternative embodiment shown in FIGS. 5 and 6 provides for the substitution of different sized and shaped holsters 76 for carrying differently shaped guns and firearms 82 as may be selected by the wearer, without the necessity of procuring a new holster assembly 10. It is anticipated that such holster assemblies may be shaped or may obtain the shape of the wearer, so that a person may wish only one such assembly 10. Nevertheless, the wearer may wish to substitute different guns and differently shaped and sized holsters 76. Thus, the holster 76 is detachable from the lower wrap 12, and another holster 76 may be substituted merely by fixing the holster 76 to the lower wrap 12 by inserting the stud 78 into the slot 80, and allowing the flanged head of the stud 78 to slid down the raceway of the slot 80, as shown in FIG. 6. The gun 82 is held firmly within the holster 76 by securing strap 77.

The remaining structure of the holster assembly remains similar to the holster assembly 10 described above. The gel pad 54 will protect the lateral malleolus 45 from abrasion and friction from the lower wrap 12. The weight of substantially the entire assembly is assumed by the the upper wrap 14, and is distributed around the circumference of the upper wrap by the crossed pattern of the cinch straps 20, 22.

The foregoing detailed description of my invention and of preferred embodiments as to products, compositions and processes, is illustrative of specific embodiments only. It is to be understood, however, that additional embodiments may be perceived by those skilled in the art. The embodiments described herein, together with those additional embodiments, are considered to be within the scope of the present invention.

I claim:

1. A holster assembly adapted for detachably securing a holster and a firearm proximate a lower leg of a person, comprising:

a. holding means for holding the holster close relative to said lower leg of a person;

b. suspension means for bearing the weight of said assembly and of a holster and of a firearm held within said holster, said suspension means substantially being separate from said stabilizing means and comprising a suspension column connected to said stabilizing means and transferring the weight from said stabilizing means to said suspension means, said suspension means substantially resting on and transferring the weight from the holster assembly to a location other than the malleoli of the lower leg; and, c. said suspension means further comprising a wrap adaptable for wrapping around the lower leg approximately on the upper portion of a gastrocnemius of the lower leg, wherein said wrap comprises a flange extending downwardly and adapted to substantially cover a head of a fibula of the lower leg.

2. The holster assembly of claim 1 wherein said suspension means rests on and transfers the weight from the holster assembly to the upper portion of the lower leg of a gastrocnemius.

3. The holster assembly of claim 1 wherein said suspension means rests on and transfers the weight from the holster assembly to an upper portion of the lower leg below the popliteal fossa of the leg.

4. The holster assembly of claim 1 wherein said holding means holds the holster proximate at least one of the malleoli of said lower leg.

5. The holster assembly of claim 4 wherein said holding means includes absorbing means for absorbing friction between said one malleolus and said holster assembly.

6. The holster assembly of claim 5 wherein said absorbing means comprises a gel positioned with said holding means to be in substantial contact with said malleolus.

7. The holster assembly of claim 1 wherein said suspension means includes means for distributing weight away from the fibula nerve.

8. The holster assembly of claim 1 wherein said holding means comprises a second wrap adaptable for wrapping around the lower leg approximately above a lateral malleolus of a leg, said second wrap including a first flange extending over a medial malleolus of a leg.

9. The holster assembly of claim 8 wherein said first flange comprises gel absorbing means including a gel positioned on said first flange to be in substantial contact with said medial malleolus, for absorbing friction between said medial malleolus and said holster assembly.

10. The holster assembly of claim 1 further comprising at least one cinch strap having a first and a second ends, said first end connected to said holding means and said second end selectively connected to said flange.

11. The holster assembly of claim 10 further comprising more than one said cinch strap.

12. The holster assembly of claim 10 wherein said cinch strap is connected at its first end to said holding means proximate a medial malleolus of said lower leg.

13. The holster assembly of claim 1 wherein said suspension means comprises a second wrap adaptable for wrapping around the lower leg approximately around a popliteal fossa of the lower leg.

14. The holster assembly of claim 1 wherein said suspension means comprises fastening means for detachably securing the holster to said suspension means.

15. A holster and holster assembly adapted for holding a firearm proximate a lower leg of a person, comprising:

a. holding means for holding the holster close relative to said lower leg of a person; and, b. suspension means for bearing the weight of said assembly and of a firearm held within said holster, said suspension means substantially being separate from said holding means and comprising:

i. an upper wrap substantially surrounding the leg above the gastrocnemius of the leg; and, ii. at least one cinch strap having two ends, one of said ends being connected to said holding means proximate said holster, and the other of said ends being connected to said upper wrap on the opposite side of the leg of the person from said holster, transferring the weight from said holding means to said suspension means by a contra-levered weight suspension.

* * * * *